United States Patent [19]

Paul

[11] 4,077,349

[45] Mar. 7, 1978

[54] LINE BOY

[76] Inventor: William A. Paul, 1808 Parkside Blvd., Toledo, Ohio 43607

[21] Appl. No.: 695,658

[22] Filed: Jun. 14, 1976

[51] Int. Cl.[2] ..... B63B 21/00

[52] U.S. Cl. ..... 114/230; 89/1 G

[58] Field of Search ..... 114/230; 9/14, 9, 314, 9/316; 102/89, 63; 89/1 G; 273/98, 129 G; 43/19

[56] References Cited

U.S. PATENT DOCUMENTS

| | | | |
|---|---|---|---|
| 1,229,170 | 6/1917 | Troje | 102/89 |
| 3,157,890 | 11/1964 | Mellon, Jr. et al. | 9/9 |
| 3,496,580 | 2/1970 | Gulmon et al. | 9/9 |
| 3,505,926 | 4/1970 | Johnson | 102/89 |
| 3,529,562 | 9/1970 | McLaren | 9/9 |
| 3,654,649 | 4/1972 | Richardson | 9/9 |

FOREIGN PATENT DOCUMENTS

| | | | |
|---|---|---|---|
| 1,147,634 | 11/1957 | France | 89/1 G |

*Primary Examiner*—Trygve M. Blix
*Assistant Examiner*—Jesus D. Sotelo
*Attorney, Agent, or Firm*—Allen D. Gutchess, Jr.

[57] ABSTRACT

A propelling device is provided for propelling lines from a boat to a dock or land. The device is particularly designed for larger pleasure boats which may have but one pilot or operator, but which normally require more than one person for docking. The propelling device includes a housing containing a projectile to which a line is attached, and a compressible gas or spring for propelling the projectile with the line to the dock as the boat is about to dock. The boat usually will be equipped with several of these devices and, in a preferred form, they can be remotely operated from the bridge or other suitable location on the boat. The projectile is preferably propelled by compressed gas, but spring arrangements can also be used.

2 Claims, 5 Drawing Figures

LINE BOY

This invention relates to a device for propelling lines from a boat to a dock to aid in the docking of the boat.

Larger boats, particularly in the nature of cabin cruisers to 25 feet or more in length, are often difficult to maneuver and dock. The difficulty is compounded when the boat is being piloted by only one operator or pilot.

The docking problem for larger boats is considerably reduced when the boats are equipped with the propelling devices in accordance with the invention. Each of these devices comprises a housing containing a projectile, preferably in the form of a resilient sphere or rubber ball, to which is attached a mooring line, the other end of the line being affixed to the boat and preferably within the housing. Compressible means are also provided for propelling the ball and the line to the dock. The compressible means can be in the form of a source of gas under pressure or springs which can be coil or torsion types.

In the preferred form, the propelling devices are remotely operated from the bridge of the boat or other suitable central location. For this purpose, the devices can be equipped with solenoid valves to supply the gas to the housing, or solenoid coils can be employed to mechanically release the ball at the desired time, especially when springs are employed as the propelling means.

It is, therefore, a principal object of the invention to provide apparatus for facilitating the docking of a boat.

Another object of the invention is to enable a larger boat to be docked more easily by a single pilot.

A further object of the invention is to provide a propelling device for propelling a mooring line from a boat to a dock.

Still another object of the invention is to provide a propelling device for propelling a line from a boat to a dock, which device is remotely operated.

Other objects and advantages of the invention will be apparent from the following detailed description of preferred embodiments thereof, reference being made to the accompanying drawings, in which.

Figure 1:
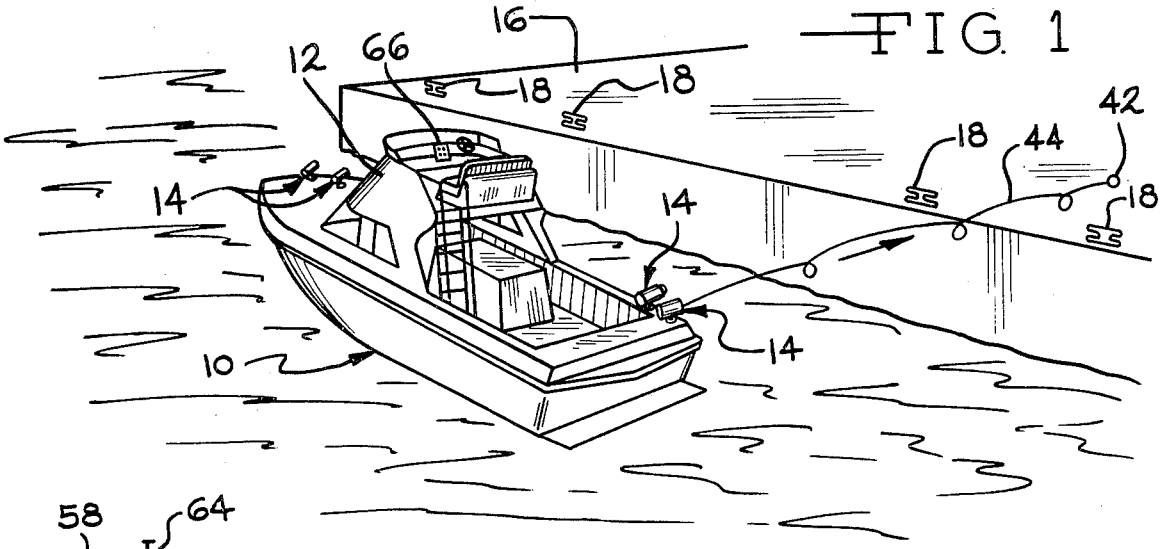
FIG. 1 is a somewhat schematic view in perspective of a boat equipped with propelling devices according to the invention.

Referring to the drawings, and particularly to FIG. 1, a boat embodying the invention is indicated at 10 and has a bridge 12 from which the boat can be steered and operated. In this instance, the boat 10 has four propelling devices 14 located along one side thereof with two near the stern and two near the bow. As the boat 10 approaches a docking facility 16, the propelling devices can be operated remotely from the bridge 12 to propel mooring lines to the docking facility. If the lines are temporary mooring lines, they can be used to help pull the boat toward the dock or to pull permanent mooring lines over so that they can be suitably secured to cleats 18. Of course, if the lines are permanent mooring lines, they can then be simply tied to the cleats 18 by someone on the docking facility. In any event, one or all four lines can be propelled to the docking facility 16 by the pilot or operator without ever having to leave the bridge 12.

Figure 2:
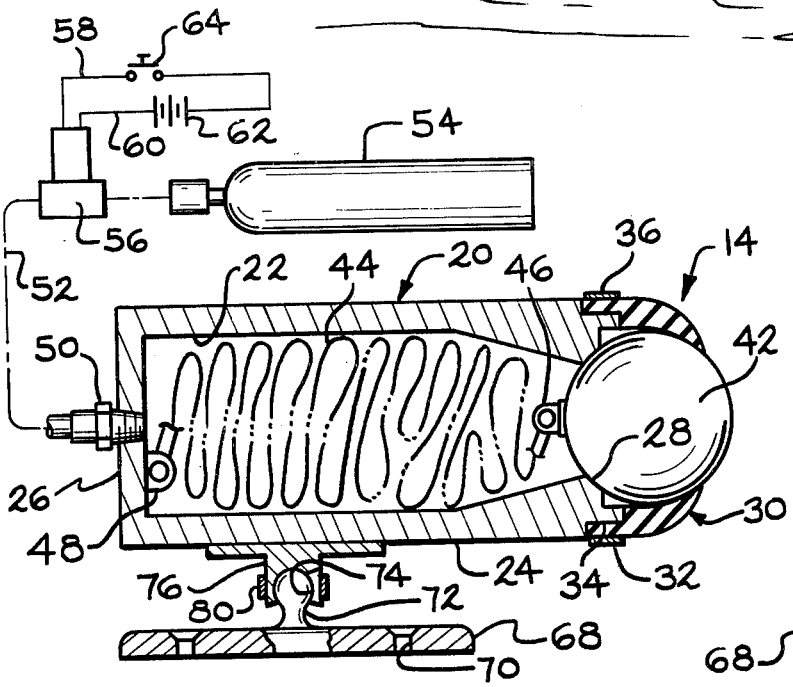
FIG. 2 is an enlarged, somewhat schematic view in longitudinal cross section of one of the propelling devices of FIG. 1, with certain components shown diagrammatically.
Figure 3:
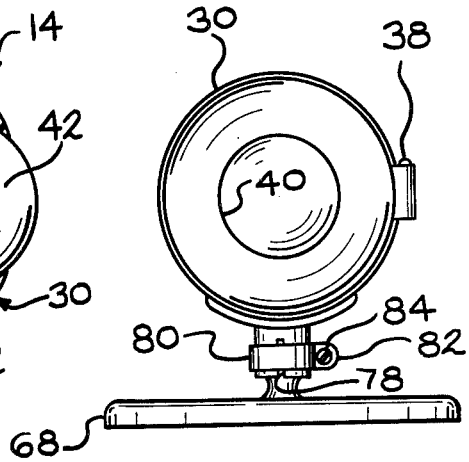
FIG. 3 is a front end view of the propelling device of FIG. 2.

A preferred form of one of the propelling devices 14 is shown in FIGS. 2 and 3. The device 14 includes a housing 20 forming a cavity or chamber 22 therein. As shown, the housing 20 has a cylindrical side wall 24 and an end wall 26, with the opposite end having an annular shoulder or seat 28 formed therein and facing outwardly. A resilient projectile-engaging member or ring 30 is mounted on the open end of the housing 20. For this purpose, the ring 30 can have an annular flange 32 which is received on a flange 34 of the housing and held thereon by a suitable strap 36 and a fastener 38. The fastener 38 can be of the worm gear type commonly found on automotive hose clamps, for example.

The ring 30 has an inwardly-extending forward lip 40 which engages a projectile in the form of a rubber sphere or ball 42 which seats against the annular shoulder 28 and is held thereagainst by the lip 40. The lip 40 is of a diameter smaller than that of the sphere 42 and is spaced from the annular shoulder 28 a distance such that the lip 40 is in a slightly stressed condition when engaging the sphere 42. This assures a gas-tight seal for the open end of the cavity 22 with the sphere 42 engaging the shoulder 28 and also being engaged by the lip 40.

In a preferred form, the sphere 42 is projected toward the docking facility 16 by gas under pressure. When so projected, the sphere 42 carries one end of a mooring line 44 by means of a suitable ring 46 affixed in the sphere. The opposite end of the mooring line 44 is affixed to the boat 10 and specifically is affixed within the cavity 22 to the rear wall 26 by a suitable ring 48.

To propel the sphere 42, the housing 20 has an inlet fitting 50 communicating with the cavity 22. The fitting 50 is connected by a suitable line 52 to a container 54 of the gas under pressure. For example, this can be a commercially-available canister of $CO_2$ which is used to operate boat horns or the like. A solenoid-operated valve 56 can be located in the line 52 between the fitting 50 and the container 54. The valve 56 can be connected through conductors 58 and 60 to a source of power 62, such as a battery, with the conductor 58 also having a switch 64 therein. The switch 64, shown as a button-operated switch, can be mounted on a panel 66 on the bridge 12, there being one of the switches 64 for each of the propelling devices 14. When the switch 64 is closed, the solenoid valve 56 is opened to supply gas under pressure from the container 54 to the cavity 22. This gas then forces out the sphere 42 toward the docking facility 16 where it carries the line 44.

It is desirable that the propelling devices 14 be able to be adjustable relative to the boat 10. For this purpose, the device 14 is equipped with a base 68 which can be mounted on the deck or gunwale of the boat by fasteners extending through fastener openings 70. The base 68 has a ball 72 extending upwardly therefrom and received in a socket 74 of a mounting member 76 which is suitably affixed to the outer surface of the housing 20. The mounting member 76 is slotted at 78 so that the socket 74 achieves a firm connection with the ball 72 when a strap 80 is tightened. The strap has ears 82 through which a bolt 84 extends with the ears being drawn together to tighten the strap when a nut (not shown) is turned onto the bolt 84. When the nut is loosened, the housing 20 can be moved for both horizontal and vertical adjustment relative to the boat.

Figure 4:
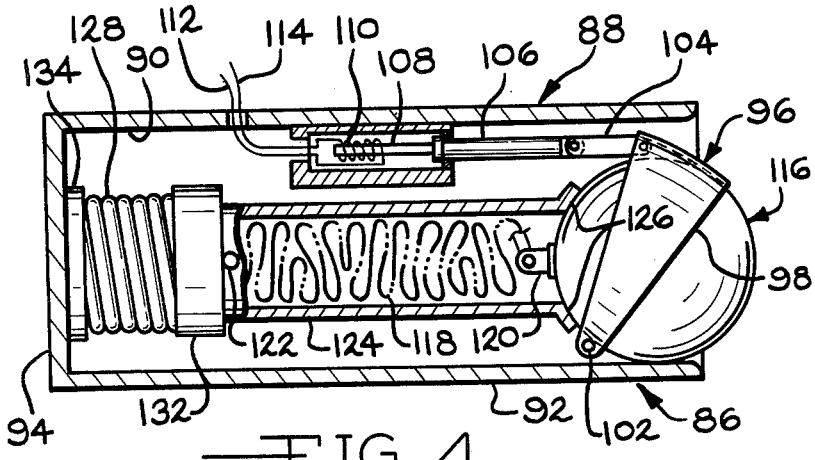
FIG. 4 is a somewhat schematic view in longitudinal cross section of a modified propelling device in accordance with the invention.
Figure 5:
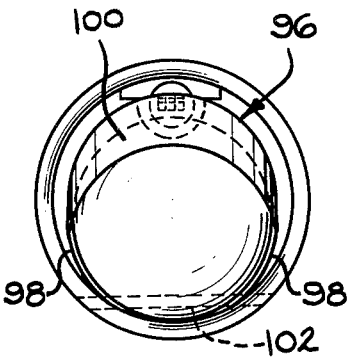
FIG. 5 is a front end view of the propelling device of FIG. 4.

A modified propelling device is indicated at 86 in FIGS. 4 and 5. In this instance, a mechanical source of power is employed, specifically a coiled spring. The propelling device 86 includes a housing 88 forming a cavity 90 with the housing having a cylindrical side wall 92 and an end wall 94. A projectile-engaging member 96 includes two arcuate legs 98 and a web 100. The lower ends of the legs 98 are pivotally mounted on a pin 102 which extends through the lower part of the cavity 90 and through the cylindrical side wall 92 where it is suitably affixed. The engaging member 96 is connected to a pivotal link 104 which, in turn, is pivotally connected to a rod 106 of a solenoid core 108. The core 108 is located in a solenoid coil 110 having conductors 112 and 114 which can extend to the power source 62 and the switch 64. When the coil 110 is energized, the core 108 is retracted and pivots the engaging member 96 in a counterclockwise direction as viewed in FIG. 4.

The engaging member 96 engages a projectile in the form of a sphere or ball 116. The sphere 116 is connected to a mooring line 118 by a ring 120 with the line 118 also being affixed to the boat and specifically to another ring 122 of the propelling device 86. The line 118, in this instance, is located within a sleeve 124 which is in the cavity 90, the sleeve forming an annular shoulder 126 against which the sphere 116 is retained by the member 96. In this instance, the sleeve 124 is affixed to an outer end of a heavy duty coil spring 128 which is under compression, a suitable mounting band 132 being provided for this purpose. The opposite end of the spring 128 is affixed to the end wall 94 of the housing 88 by a suitable ring 134.

When the switch 64 is closed and the coil 110 energized, the counterclockwise movement of the retaining member 96 frees the sphere 116 and enables the spring 128 to abruptly extend and project the sphere 116 toward the docking facility 16. The sleeve 124 is held on the spring 128 which in turn is held in the housing 88 so that only the ball and the line are propelled.

Various modifications of the above-described embodiments of the invention will be apparent to those skilled in the art, and it is to be understood that such modifications can be made without departing from the scope of the invention, if they are within the spirit and the tenor of the accompanying claims.

I claim:

1. A propelling device for propelling a line from one location toward another, said device comprising a housing forming a cavity, a projectile, means for releasably holding said projectile at one end of said cavity, a line having one end affixed to said projectile and another end affixed to said housing, means for establishing a force within said cavity against said projectile to cause said projectile to be ejected from said housing along with said line, said force means comprising a spring within said cavity, said releasably holding means comprising mechanical means engaging said projectile, and remotely-controlled means for disengaging said mechanical means from said projectile.

2. In combination, a boat, at least one propelling device affixed in a predetermined position on the boat for propelling a line to a dock or the like to aid in the docking of the boat, said device comprising a housing forming a cavity, a projectile in the form of a resilient sphere, means for holding said projectile at one end of said cavity, said holding means being a resilient, projectile-engaging ring mounted at the open end of said cavity and having a resilient lip holding said sphere, a line having one end affixed to said projectile, means for supplying gas under pressure to said cavity for applying a force within said cavity to said projectile to propel said projectile away from said housing toward the dock, and means including remotely-located means for causing said gas-supplying means to supply the gas under pressure to said cavity, said last-named means being an electrically-operated valve, and switch means for operating said valve being located at a pilot's steering station.

* * * * *